US009833871B2

(12) United States Patent
Froněk

(10) Patent No.: US 9,833,871 B2
(45) Date of Patent: Dec. 5, 2017

(54) SANDER, ESPECIALLY FOR SANDING CURVED SURFACES

(71) Applicant: Petr Froněk, Ričany u Prahy (CZ)

(72) Inventor: Petr Froněk, Ričany u Prahy (CZ)

( * ) Notice: Subject to any disclaimer, the term of this patent is extended or adjusted under 35 U.S.C. 154(b) by 159 days.

(21) Appl. No.: 14/768,145

(22) PCT Filed: Feb. 17, 2014

(86) PCT No.: PCT/CZ2014/000017
§ 371 (c)(1),
(2) Date: Aug. 14, 2015

(87) PCT Pub. No.: WO2014/124614
PCT Pub. Date: Aug. 21, 2014

(65) Prior Publication Data
US 2015/0367476 A1 Dec. 24, 2015

(30) Foreign Application Priority Data
Feb. 15, 2013 (CZ) ..... 2013-107

(51) Int. Cl.
*B24B 23/04* (2006.01)
*B24D 15/04* (2006.01)

(52) U.S. Cl.
CPC ..... *B24B 23/04* (2013.01); *B24B 23/043* (2013.01); *B24D 15/04* (2013.01)

(58) Field of Classification Search
CPC ..... B24B 23/04; B24B 23/043; B24D 14/04
See application file for complete search history.

(56) References Cited

U.S. PATENT DOCUMENTS

| | | | | |
|---|---|---|---|---|
| 4,686,797 | A * | 8/1987 | Hoffman | B24B 23/043 15/22.1 |
| 6,855,041 | B2 * | 2/2005 | Bocka | B24D 15/023 451/344 |
| 6,857,948 | B2 * | 2/2005 | Bocka | B24D 15/023 451/344 |
| 8,696,413 | B2 * | 4/2014 | King, Jr. | B24D 15/04 451/344 |
| 2009/0178224 | A1 * | 7/2009 | Fronek | B25G 1/06 15/235.8 |
| 2010/0261414 | A1 * | 10/2010 | Fronek | B24B 23/04 451/28 |
| 2013/0072097 | A1 * | 3/2013 | King | B24D 15/04 451/527 |

FOREIGN PATENT DOCUMENTS

| | | | |
|---|---|---|---|
| FR | 2964892 | A1 | 3/2012 |
| GB | 2450219 | A | 12/2008 |
| WO | 2009/000219 | A2 | 12/2008 |

OTHER PUBLICATIONS

International Search Report for PCT/CZ2014/000017 filed on Feb. 17, 2014.

* cited by examiner

*Primary Examiner* — Timothy V Eley
(74) *Attorney, Agent, or Firm* — Nataro, Michalos & Zaccaria P.C.

(57) ABSTRACT

A sander especially suited for sanding curved surfaces. The sander has an elongate body and a grinding plate movably attached thereto. A power unit drives the grinding plate. At least two lever beams are attached to the elongate body. Each of the lever beams has two opposite ends. The grinding plate is attached to ends of lever beams using flexible connecting elements to allow the grinding plate to move relative to the sander body.

9 Claims, 3 Drawing Sheets

SANDER, ESPECIALLY FOR SANDING CURVED SURFACES

FIELD OF INVENTION

The invention relates to hand operated and power-driven sanding machines for sanding large plane, or convex or concave curved areas.

DESCRIPTION OF THE RELATED ART

In order to grind large plane or differently curved surface areas, a large number of different sanders or grinders are used, dividend either according to the driving mechanism (pneumatic, electrical) or particularly according to the principal (linear, belt, rotational, rotation-orbital or vibrating). All these kinds of sanders disclose substantial insufficiencies during grinding of large and curved surface areas substantial insufficiencies due to size and insufficient flexibility of their grinding surface, which is not capable of adapting to any curving of the grinding surface area and grinding of unwanted areas or holes may occur due to an inattentiveness of the operating personal. Such disadvantages have been solved by a patent application No, WO2009000219 in which a grinding segment is represented by one light flexible blade, that is pressed to the grinded surface by means of a flexible pressing plate. From the bottom, the flexible blade is provided with a grinding material and it moves between the pressing plate and the grinded surface so it gradually reaches the curving parameters as the pressing blade has. An equally distributed pressing force is obtained through a system of lever beams. However, despite numerous advantages of this technical solution, several fundamental disadvantages have occurred. One of them is the fact that the flexible blade being pressed to the grinded surface by means of the pressing plate, is significantly hindered, so a use of sufficiently designed driving mechanism and transmission mechanism are required, not only in terms of a required power but also in terms of the rate of the required torque. Driving mechanisms turned to be very bulky with high consumption of the electric power or possibly of the compressed air. Further disadvantage is a continuous mutual wear of the pressing plate and flexible blades. A third fundamental disadvantage is an insufficient torsional stiffness of so designed sanders, thus a grinding of curved surface areas is possible only in parallel with the axis of curvature of the grinded surface or transversally to it.

SUMMARY OF THE INVENTION

The above mentioned disadvantages are removed or at least substantially limited by a sander for grinding of large plane, namely but for grinding of curved surface areas, that has according to this invention a flexible grinding plate attached to the body of the sander by means of at least two lever beams, thus similarly to WO22009000219 the pressing force of the grinding plate onto a grinded surface is substantially equally distributed, whereas according to this invention the flexible grinding plate is attached to the ends of the lever beams by means of flexible connecting elements and it is connected to a driving mechanism causing to vibrate the flexible grinding plate through a shaft provided with an off-center pivot allowing a transformation of a rotational movement of the driving mechanism onto a sliding linear or orbital movement of the flexible grinding surface, i.e. to a movement carried out by the grinding plate when grinding the surface area; whereas the driving mechanism of the flexible grinding plate is designed to allow a change of relative distance between the flexible grinding plate and the body of the sander, said change being caused due to a required bending of the grinding plate, i.e. according to its deformation when being adapted to the shape of the grinded surface. According to a preferred embodiment of the invention, the lever beams are provided with arms protruding on two opposite sides from the place of the attachment of the lever beam, whereas on the and of each arm of the lever beam, a flexible connecting element is arranged, said flexible element connects the grinding plate with the lever beam. The lever beams are arranged so allow a pivotal movement in relation to the body of the sander. More preferably the lever beams are anchored on pivotal pins, whereas the pivotal movement is allowed especially in the longitudinal direction of the flexible grinding plate, thus allowing its adaption to the shape of the grinded surface.

Preferably the flexible connecting elements are accomplished as silent-blocks, but the can be also accomplished as springs or similar parts that allow an equally distributed pressing force onto the flexible grinding plate, and also allowing its shapeability/malleability towards the grinded surface. Adapting the shape of the flexible grinding plate is accomplished advantageously not only in the radial but also in diagonal curving direction of the grinded surface. In an embodiment of the sander according to the invention with a firmly mounted driving unit, the attachment of the flexible grinding plate by means of flexible connecting elements allows for finishing the transformation of the movement of the driving unit onto the flexible grinding surface.

For a purpose of this invention, a term flexible grinding plate also intends to cover an embodiment of the grinding plate consisting of several, e.g. two or more, separate grinding segments. In case of the example of the embodiment according to the FIG. 2, the driving unit is arranged directly on the base plate and the flexible grinding plate, rather in this case plate segments forming the flexible grinding plate, are attached to the base plate by means of flexible connecting elements, being advantageously in this case silent-blocks, allowing the grinding segments to vibrate with regard to the base plate as in the preceding case.

The base plate itself is pressed to the grinded surface by means of lever beams, allowing shaping of the tool according to the curvature of the grinded surface, as well as partial torsional curving, substantially regardless of the immediate deformation of the grinding plate and its mutual position in respect of the body of the sander. In this example of the embodiment of the present invention comprising the power unit connected firmly with the body of the sander, the mutual position is delimited only by the utmost positions of the grooved, telescopic, shaft, that connects the power unit with the flexible grinding plate and also by the maximal elasticity of the flexible connecting elements. Preferably such embodiment comprises a grinding plate consisting of at least two flexible grinding elements/blades/that exhibit a relative movement in relation to the body of the sander as well as to the basic flexible plate. The flexibility and stiffness of the basic plate mostly restricts also curvature parameters of the grinding segments.

The above described arrangement allows for a construction of a tool of substantially any length having number of grinding segments. Driving such grinding segments can be done preferably through several independent power units, each driving either one grinding segments. Possibly, one power unit can drive two or more grinding segments, whereas the drive on individual segments can be done by means of a flexible shafts etc.

As already mentioned, to drive grinding plates or possibly grinding segments of the sander according to this invention, it is possible to use any appropriate power unit used for handheld tools. That means, besides electric motors, also pressurized air-operated motors and similar power units can be used.

BRIEF DESCRIPTION OF THE DRAWINGS

The subject of the invention will be more apparent with a help of the drawings, on which

DETAILED DESCRIPTION OF EMBODIMENTS OF THE INVENTION

Example 1

Figure 1:
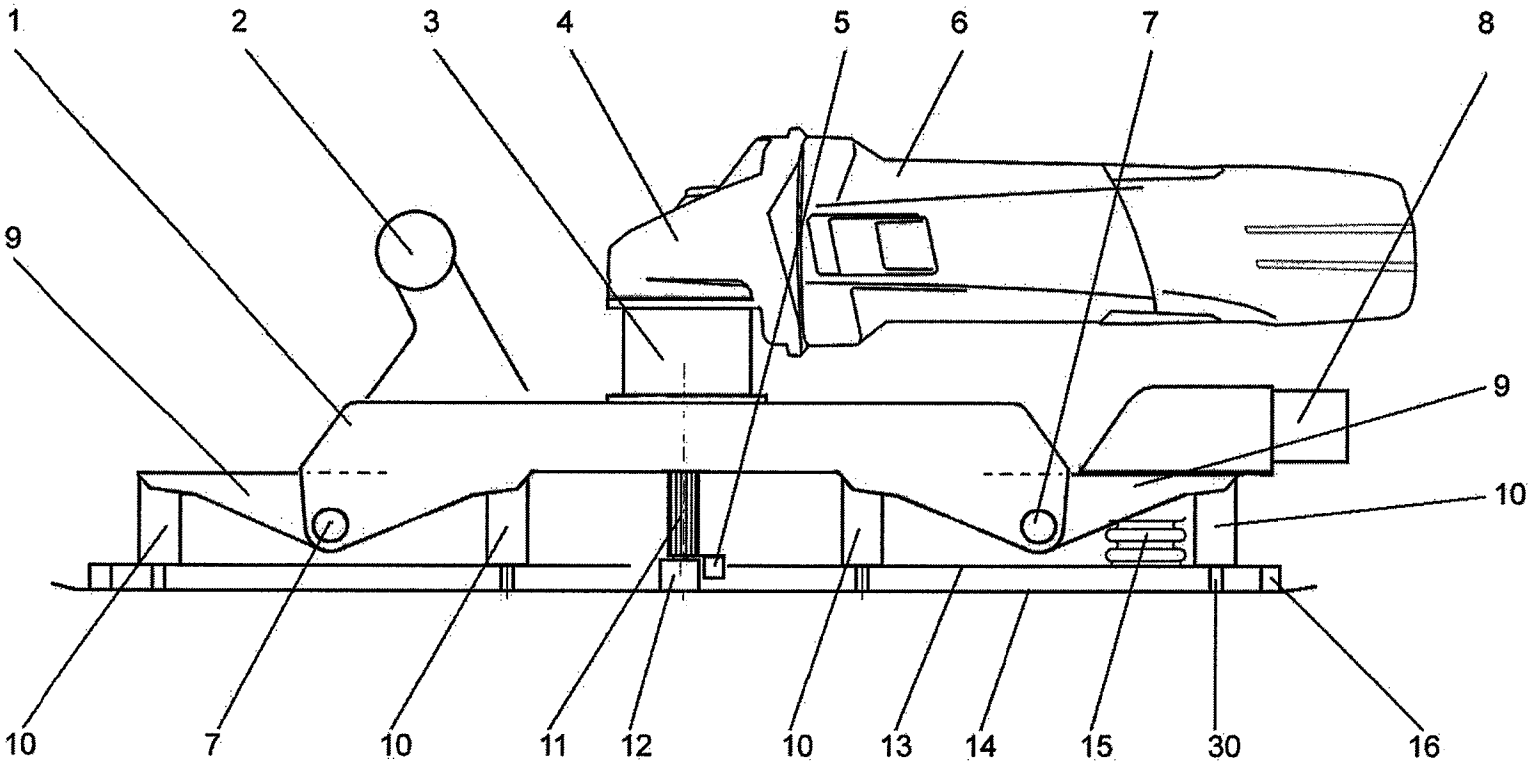
FIG. 1 illustrates the basic principle of the sander according to the invention by means of an example of the embodiment with a grinding plate in one piece.

A sander for grinding curved surface areas according to FIG. 1 is accomplished with a body 1 of the sander, having a power unit 6 placed on it. The Power unit 6 is in the present example an electric motor having an angled transmission unit 4, which is mounted on a bearing case 3 with a telescopic grooved shaft 11. The grooved shaft 11 allows for a transmission of the torque from the power unit to the grinding plate 14 even in different bents of the grinding plate 14 due to its adaptation to a shape the grinded surface area. The grooved shaft 11 is provided on its end with an eccentric pivot, whereas the distance of its off-sett from the longitudinal axis of the grooved shaft imparts the relative movement, i.e. oscillation, being performed by grinding plate 14 in relation to the body 1 of the sander. The pivot is accommodated in the bearing case 12 which is firmly connected to the grinding plate 14. The grinding plate 14 is attached to the body 1 of the sander by means of four pairs of flexible connecting elements 10, in this example also formed by a silent-block, and by means lever beams 9, pivotally situated on pins 7. The flexible connecting elements 10 provide for either an equally distributed pressure of the grinding plate onto the grinded surface, an either for partial torsion deformation and flexible adaptation of the grinding plate 14 towards the grinded surface. When fixing the shape of the grinding plate 14 would be required, it is possible to fix the position of the lever beams 9 in relation to the body 1 of the sander by means of appropriate locks or possibly by means of transversal mortising etc.

In a preferable embodiment of the sander according to the invention, the grinding plate 14 is provided with orifices allowing extraction of sanding dust. The arrangement of the extraction system comprises a grinding plate 14 provided with a cover plate 13 with a sealing 16. The cover plate 13 is connected with a sleeve 8 arranged so as to allow a connection of an extraction device, being place on a lever beam 9, through a flexible bellow 15. After connection of the extraction device, suction occurs between the grinding plate 14 and the cover plate 13 by means of which material remover by grinding is extracted.

In order to reduce vibrations, the sander is equipped with a counterweight 5. The grooved shaft 11 with the counterweight 5 may be covered with a flexible sleeve in order to provide sealing against dust as well as to provide safety covering of the rotating counterweight 5.

Example 2

Figure 2:
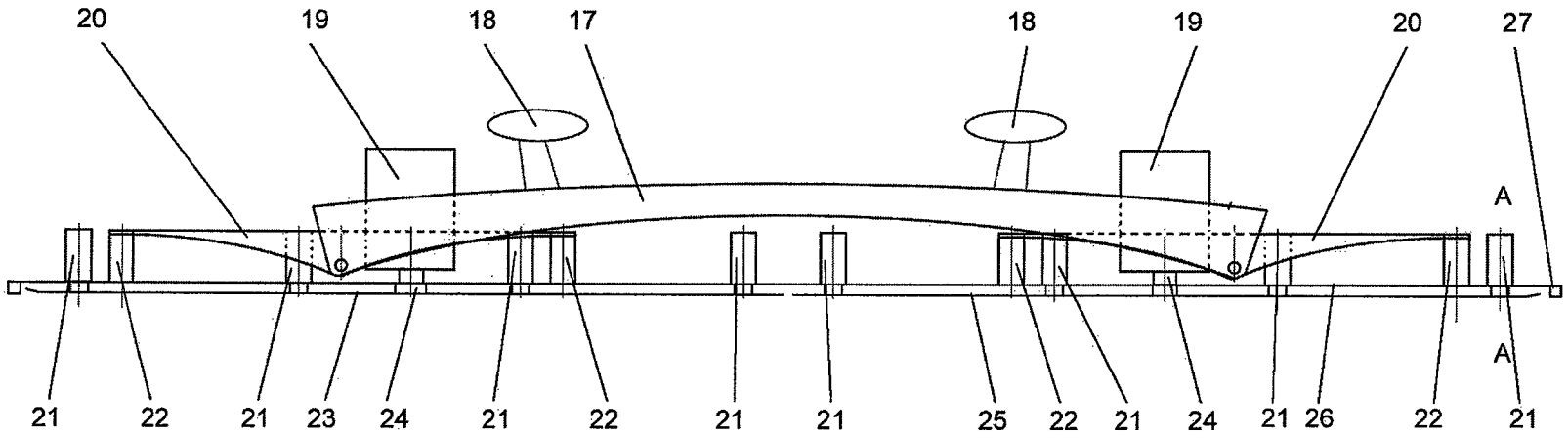
FIG. 2 illustrates the principles of the sander with a grinding plate consisting of two grinding elements.
Figure 3:
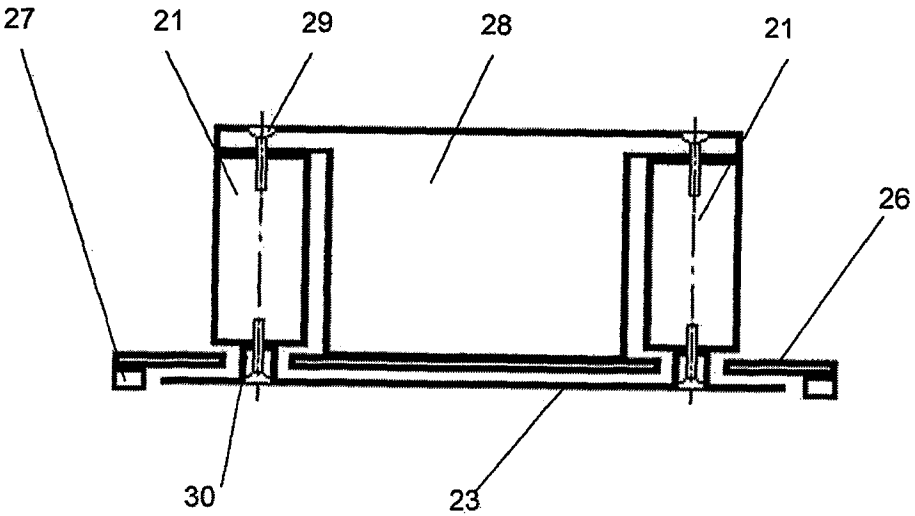
FIG. 3 illustrates a detail of a connection of basic flexible plate and the flexible moving segment in a section A-A from FIG. 2.

A sander for grinding curved surfaces according to FIG. 2 is in principle similar to the sander according to FIG. 1. The difference from FIG. 1. is, that the grinding plate is in this embodiment formed of a flexible base plate 26 and of flexible grinding segments (blades) 23,25. The parameters as flexibility and stiffness of the tool are determined in by the flexible base plate 26 in this embodiment, instead of the grinding plate as it was in the embodiment from FIG. 1. The grinding itself is accomplished by two flexible grinding segments 23, 25 that are attached to the flexible base plate 26 through flexible connecting elements 21, 22 and brackets 28. Again, the flexible connecting elements are on FIG. 2 accomplished as silent-blocks. Each of the grinding segments 13, 25 is connected with the flexible base plate 26 by means of four brackets 28, displace equally along the length of the grinding plate, and four pairs of flexible connection elements 21. Said flexible connection elements 21 keep the grinding elements 23,25 in a relatively constant distance from the base plate 26, regardless of its deformation (bending). Thus designed mounting which uses flexible connection elements, silent-blocks in the example, allows for movement of the grinding segments in relation to the flexible base plate 26, similarly to the embodiment on FIG. 1. Each of these grinding segments 23, 25 is driven independently by a power unit 19, provided with a shaft with an eccentric pivot so as to transform the rotational movement of the power unit onto a sliding linear or orbital movement of each grinding segments 23, 25. Said power units are firmly connected to a flexible base plate 26. The base plate 26 replaces in this embodiment the function of the body 1 of the sander on FIG. 1, as it is connected with the body 17 of the sander and it does not carry out any grinding movements in relation to the body 17. The power unit 19 can be represented by e.g. a separate motor as seen on FIG. 2, but it can be also represented by a transmission unit, which is driven by a flexible shaft or cardan shaft from one central motor, etc. In case the transmission units are used, it is preferred to set the mutual synchronization of their movements so the grinding plates move one against the other. This way is preferred especially in case even number of the grinding segments. The flexible base plate 26 is equipped with similar system of equal distribution of the force onto the grinded surface area, as in case of the embodiment on FIG. 1, using the lever beams 20 connected with the flexible base plate 26 by means of silent-blocks 22. The lever beams 20 are connected with the body 17 of the sander by means of pivots allowing turn movement of the lever beams 20 in relation to the body 17. The flexible base plate 26 can be advantageously used in a sanding dust extraction. The flexible base plate overlaps the flexible grinding segments on its each side. To the overhang, sealing profile 27 is attached, reaching up to the grinded surface, thus creating a closed space. It is sufficient to attach properly an extraction device to the flexible base plate 26. It is possible to fix the position of the lever beams 20 relative to the body 17, thus fixing the respective plane or bending diameter as in case of the example 1. The technical solution according to FIG. 2 allows for a use of substantially any number of the flexible grinding segments. So a construction of a tool with substantially any length is possible.

An implementation of a power unit on FIG. 1 and FIG. 2 is mentioned only as an example and it is possible to combine them as required. It means that any implementation is linked only for the respective embodiment of the sander. Thus it is possible to use for the embodiment of the sander from FIG. 1 an analogous embodiment of the grinding plate from FIG. 2 etc.

INDUSTRIAL APPLICABILITY

The design of the sander according to the invention can be used in a structure of new types of sanders or grinding machines for grinding different types of curved surface areas in all fields of industry.

LIST OF REFERENCE NUMERALS

1—body of the sander
2—grip/handle
3—bearing case
4—transmission unit
5—counterweight
6—power unit
7—pivot
8—sleeve for an extraction
9—lever beam
10—flexible connecting element
11—grooved shaft with an eccentric pivot
12—bearing case
13—cover plate
14—flexible grinding plate
15—extraction bellow
16—sealing elastomer
17—body of the sander
18—grip/handle
19—power unit
20—lever beam
21—flexible connecting element
22—flexible connecting element
23—flexible grinding segment A
24—shaft with an eccentric pivot
25—flexible grinding segment B
26—flexible base plate
27—sealing
28—bracket of the flexible connecting elements
29—screw
30—spacer

The invention claimed is:

1. Sander especially for sanding curved surface areas, comprising:

an elongate body (1,17);

a sanding plate (14) movably attached to said body (1, 17); and a power unit (19) connected to said sanding plate (14) for driving said sanding plate to provide a sanding motion of said sanding plate, wherein the sanding plate (14) is connected with said body (1) by at least two movable lever beams (9, 20) that are attached to said body (1, 17) one apart from another, said lever beams being provided with two opposite ends, wherein said sanding plate (14) is attached to said ends of said movable lever beams (9,20) by elastic connecting elements (10, 21) allowing to equally distribute a pressing force onto said flexible sanding plate, and allowing a shapeability/malleability of said sanding plate towards said curved surface, and enabling said sanding plate to make a defined linear or orbital motion relative to said body (1, 17) when driven by said power unit.

2. Sander according to claim 1, wherein, each lever beam (9, 20) is movably attached by means of a pivot (7) to said body (1), wherein said two flexible connecting elements (10, 21) are attached at each opposite end of said movable lever beams (9, 20), wherein said flexible sanding plate is connected over said flexible connecting elements (10,21) with said lever beams (9) so as to provide for a longitudinal flexibility of said sanding plate towards a curvature of said curved surface area to be sanded, said flexible connection of said sanding plate (14) allowing a relative sanding motion of said sanding plate towards said body (1), when being driven by said power unit, regardless of a deformation of said sanding plate and a mutual position of said sanding plate to said elongate body (1).

3. Sander according to claim 1, wherein said sanding plate (14) is attached to said power unit by means of a grooved shaft (11) having a variable length, said grooved shaft (11) being provided on an end of it with an eccentrically mounted pivot, rotating in a bearing case (12), whereas an off-set distance of said pivot defines a magnitude and direction of a movement of said sanding plate in relation to said body (1).

4. Sander according to claim 1, wherein said variable length grooved shaft (11) is provided on an end of it with a counterweight (5) in order to eliminate sanding plate inertia forces as well as vibrations induced by said forces into said body (1).

5. Sander according to claim 1, wherein a flexible cover plate is arranged in parallel with said sanding plate (14), an elastic sealing (16) being arranged between said flexible cover plate and said sanding plate so as to bond them together and/or to seal them together.

6. Sander according to claim 5, wherein a space is arranged between said sanding plate (14) and said cover plate (13), said space between said sanding plate and said cover plate being in communication with an extraction sleeve (8), whereas said sanding plate (14) is provided with openings arranged for an extraction of a material sanded by said sanding plate (14) through said sleeve (8).

7. Sander according to claim 6, wherein said sanding segments (23,25) are connected with said base plate by means of flexible connecting elements connected to at least three brackets (28).

8. Sander according to claim 1, wherein said sanding plate (14) comprises a flexible basic plate (26) and at least two flexible sanding segments (23, 25), said at least two flexible sanding segments (23, 25) being arranged in parallel with said flexible basic plate (26), said flexible sanding segments (23, 25) being driven to carry out a relative moment in relation to said body and said base plate.

9. Sander according to claim 1, wherein said flexible connecting element is a rubber bushing or a spring.

* * * * *